US006149512A

United States Patent [19]

Wilson et al.

[11] Patent Number: 6,149,512

[45] Date of Patent: Nov. 21, 2000

[54] LINEAR PAD CONDITIONING APPARATUS

[75] Inventors: Ethan C. Wilson, Sunnyvale; H. Alexander Anderson, Santa Cruz; Gregory Appel, San Francisco, all of Calif.

[73] Assignee: Aplex, Inc., Sunnyvale, Calif.

[21] Appl. No.: 08/965,514

[22] Filed: Nov. 6, 1997

[51] Int. Cl.[7] ..... B24B 53/00

[52] U.S. Cl. ..... 451/443; 451/320; 451/324; 451/444; 451/164

[58] Field of Search ..... 451/443, 444, 451/56, 450, 164, 167, 168, 320, 324, 299, 306, 307

[56] References Cited

U.S. PATENT DOCUMENTS

| | | | |
|---|---|---|---|
| 3,571,979 | 3/1971 | Manchester | 451/56 |
| 3,753,269 | 8/1973 | Budman | 451/444 |
| 5,456,627 | 10/1995 | Jackson et al. | 451/56 |
| 5,484,323 | 1/1996 | Smith | 451/56 |
| 5,611,943 | 3/1997 | Cadien et al. | 451/444 |
| 5,692,947 | 12/1997 | Talieh et al. | 451/443 |
| 5,779,526 | 7/1998 | Gill | 451/56 |
| 5,885,147 | 3/1999 | Kreager et al. | 451/56 |
| 5,916,010 | 6/1999 | Varian | 451/56 |

*Primary Examiner*—Eileen P. Morgan
*Attorney, Agent, or Firm*—Skjerven, Morrill, MacPherson, Franklin, Friel LLP; Edward C. Kwok

[57] ABSTRACT

A linear pad conditioning mechanism provides a linear in situ or ex situ conditioning for a polishing pad mounted on a polishing belt of a CMP apparatus. The linear pad conditioning mechanism includes a linear oscillation mechanism for driving a conditioning pad in a direction orthogonal to the polishing belt's direction of travel. In one example, multiple conditioning assemblies are provided to each provide a trapezoidal conditioning pad, and the conditioning assemblies are positioned such that a constant-width area in the polishing belt's direction of travel is provided. In that example, a rotational mechanism is provided to position the conditioning pad between a conditioning position against the polishing pad, and a cleaning position in a bath of cleaning fluid. Further, each conditioning assembly is provided a fluid delivery system to a conditioner block, so that a conditioner fluid can be delivered at the point of use.

19 Claims, 10 Drawing Sheets

LINEAR PAD CONDITIONING APPARATUS

BACKGROUND OF THE INVENTION

1. Field of the Invention

The present invention relates to polishing, including chemical-mechanical polishing (CMP). In particular, the present invention relates to a mechanism for conditioning the surface of a polishing pad used in polishing operations.

2. Discussion of the Related Art

In sub-micron integrated circuits, CMP techniques are used to create the planarity required in multilevel interconnect structures. Specifically, to create a planar surface for depositing an interconnect layer, e.g. aluminum or titanium-tungsten, an interlayer dielectric (e.g., silicon dioxide) is planarized by a polishing process which uses a slightly alkaline colloidal slurry as a hydrolizing fine abrasive. One example of such a slurry includes fine silicon dioxide particles (e.g., average diameter of 70 nm) suspended in deionized water having an adjusted pH of approximately 11. The alkalinity can be provided by potassium hydroxide (KOH) and ammonium hydroxide ($NH_3OH$).

To maintain uniformity in the resulting surface of the interlayer dielectric and to provide reproducibility of the polishing process, the polishing surface, which is typically a polyurethane pad, is required to be conditioned between or during use. Conditioning is necessary to maintain the polishing pad to a uniform, textured or profiled surface.

FIG. 1 illustrates pad conditioning in the prior art. FIG. 1 shows, schematically, a prior art CMP apparatus 100. As shown in FIG. 1, CMP apparatus 100 includes a rotating platen 103, rotating in the direction indicated by reference numeral 105. On platen 103 is mounted a polishing pad 104. A silicon wafer (not shown) is held by a rotating polishing head 101 and pressed against the surface of polishing pad 104. Polishing head 101 rotates in a direction 109, generally in the same direction 105 of rotating platen 103. In addition, an oscillating arm 106 moves polishing head 101 to and fro along an arc indicated by reference numerals 108*a* and 108*b*. Correspondingly, a conditioning pad (not shown) is held by a smaller platen 102 against polishing pad 104. Platen 102 rotates in the direction indicated by reference numeral 110 and is moved to and fro along an arc indicated by reference numerals 107*a* and 107*b* by an oscillating arm 111. In this configuration, polishing pad 104 is continuously being conditioned in CMP apparatus 100 as a result of the motion in oscillating arm 111 and platen 102.

However, the conditioning process described in conjunction with FIG. 1 has at least one drawback. Specifically, the complex non-linear motions of the various components of CMP apparatus 100 often lead to excessive wear near the center of platen 103 and less wear in the periphery. Consequently, non-uniformity is introduced through polishing pad 104 into the wafer being polished.

SUMMARY OF THE INVENTION

The present invention provides a linear pad conditioning mechanism for a moving polishing pad in a CMP apparatus. The present invention is applicable especially to a polishing pad mounted on a polishing belt which is driven by pulleys in a continuous loop operation.

In one embodiment, the conditioning mechanism includes: (a) multiple conditioning assemblies, where each conditioning assembly includes a conditioning pad for conditioning a predetermined portion of the surface of the polishing pad; (b) a positioning mechanism for driving each of the conditioning assemblies to its predetermined portion of the surface of the polishing pad; and (c) a linear oscillating mechanism driving each of the conditioning assemblies in an oscillatory motion along a direction orthogonal to the polishing belt's direction of travel. In one embodiment of the present invention, the conditioning assemblies each include a built-in fluid delivery system to allow a conditioning fluid to be delivered to the conditioning pad. In this manner, conditioning of the polishing pad can be achieved at the point of use. The present invention allows both in situ conditioning (i.e., conditioning of the polishing pad concurrently with a wafer is being polished) and ex situ conditioning (i.e., conditioning of the polishing pad between wafers).

In addition, a rotational mechanism can be provided to allow a rotational motion to position each of the conditioning assemblies from a first orientation to a second orientation, so as to allow the conditioning pads to be cleaned in a cleaning bath between conditioning operations without removal.

In one embodiment, a fluid inlet is provided in a conditioner block to receive a conditioning fluid and one or more fluid ports are provided on a surface facing the polishing pad. The fluid ports provide the conditioning fluid to the polishing pad. In one implementation, the conditioning fluid is forced through the perforations of a conditioning pad. In another implementation, multiple port openings and v-grooves are provided so that, under pressure, the conditioning fluid is dispensed in a fine spray along a preferred direction relative the polishing belt's direction of travel.

In one implementation, each of the conditioning assemblies includes a trapezoidal surface for attaching the conditioning pad. Each conditioning pad includes trapezoidal surfaces separated by grooves. The conditioning pads and the conditioning assemblies are positioned such that, in the direction of the polishing belt's travel, the conditioning assemblies and the conditioning pads together provide a constant-width surface for the conditioning operation. With this configuration, every point on the polishing pad is conditioned by an equal amount of conditioning pad material prior to coming into contact with the semiconductor wafer being polished.

In accordance with another aspect of the present invention, the linear pad conditioning mechanism provides each of the conditioning assemblies a gimballing mechanism to allow the conditioning pad to gimbal around a predetermined position up to a predetermined solid angle. In one implementation, the gimballing mechanism is achieved by a plane-spherical bearing.

In accordance with another aspect of the present invention, the linear pad conditioning mechanism provides a conditioner block having a gimballing mechanism for positioning the conditioning pad to achieve maximum contact with the polishing pad.

The positioning mechanism, the linear oscillation mechanism and the rotational mechanism can each be implemented using pneumatically driven air cylinders. In one embodiment, the pneumatically driven air cylinders in the positioning mechanism can be individually adjusted for improved control of the conditioning operation.

In one embodiment, a brush is provided in the cleaning bath. In that implementation, the brush includes bristles provided on a base, which is provided (a) a fluid inlet for receiving the cleaning fluid; (b) fluid ports opening to the bristles for delivering the cleaning fluid to the bristles; and (c) a conduit within the base coupling the fluid inlet to the fluid ports. In addition, the base includes slanting surfaces to facilitate a flow of the cleaning fluid carrying slurry particles from the bristles.

The invention is better understood upon consideration of the detailed description below and the accompanying drawings.

DETAILED DESCRIPTION OF THE PREFERRED EMBODIMENTS

Figure 1:
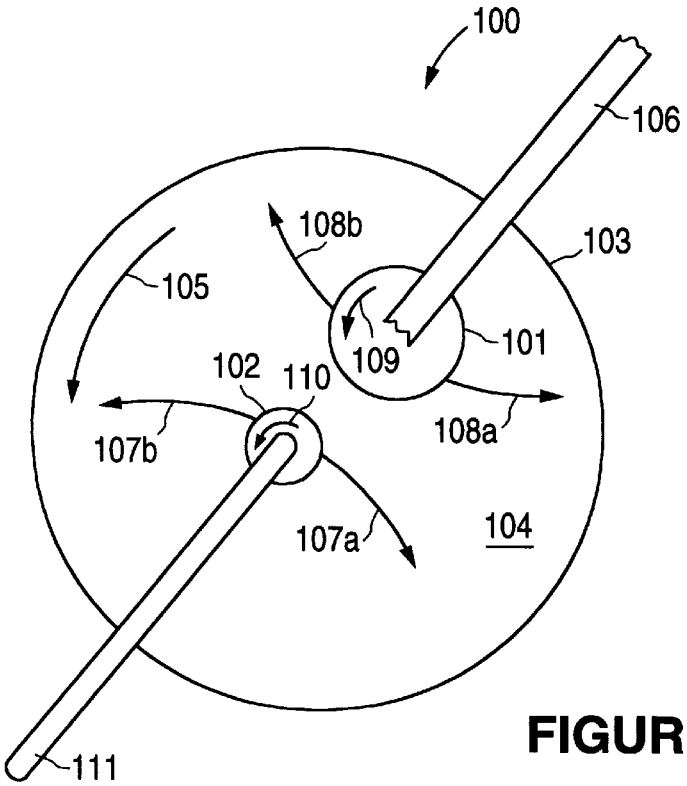
FIG. 1 shows a CMP apparatus 100 for polishing semiconductor wafers in which a polishing pad 104 is condition ed by a conditioning pad in accordance with a method of the prior art.

The present invention provides a conditioning apparatus for a CMP polisher. Using a linear mechanism, the conditioning apparatus provides uniform conditioning for a polishing pad, so as to ensure that the profile of the polishing pad results in a uniform polished wafer surface. To simplify this detailed description, like elements shown in multiple figures are provided like reference numerals.

Figure 2A:
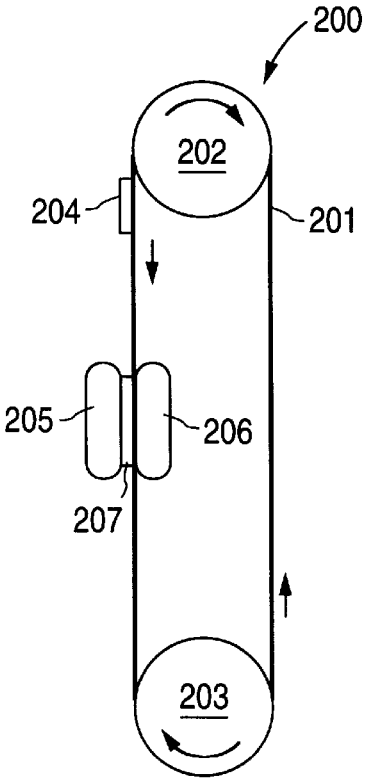
FIGS. 2*a* and 2*b* show, respectively, a side and front views of a portion of CMP apparatus 201, in which the pad conditioning assembly 204 can be implemented in accordance with the present invention.
Figure 2B:
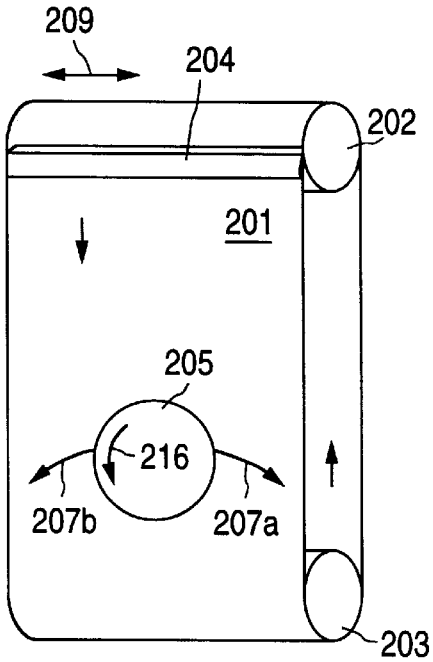

The present invention can be used in conjunction with a CMP apparatus 200, which is illustrated schematically in side and front views in FIGS. 2*a* and 2*b*. An example of such a polishing apparatus is disclosed in a copending patent application, entitled "Modular Wafer Polishing Apparatus and Method," by Paul Cheng et al., Ser. No. 08/964,930, filed on Nov. 5, 1997, now U.S. Pat. No. 5,957,764, issued on Sep. 28, 1999 and assigned to Aplex Group, which is also the Assignee of the present application. As shown in FIGS. 2*a* and 2*b*, CMP apparatus 200 includes a continuous polishing belt 201 configured to polish one or more vertically held semiconductor wafers, such as wafer 207. Wafer 207 is held vertically by a polishing head 205, which presses wafer 207 against a polishing pad attached to a vertically mounted polishing belt 201. Polishing belt 201 is kept in continuous motion by rotating pulleys 202 and 203 at a selected polishing speed (e.g., 1–10 meters per second). A support head 206 provides a backward pressure to hold wafer 207 at a preselected pressure (e.g., 1–5 PSI) against polishing belt 201. Polishing head 205 rotates in a predetermined direction indicated by reference numeral 216 and is moved to and fro by oscillating mechanism 208 (not shown) over the polishing pad surface along an arc indicated by reference numerals 207*a* and 207*b*. Thus the combined motions in polishing belt 201, polishing head 205 and oscillating mechanism 208 provide linear polishing for the surface of wafer 207. While FIG. 2 shows only one side of the polishing belt assembly being used for wafer polishing, wafer holders can be provided on both sides of the polishing belt assembly of CMP apparatus 200 to increase the total wafer throughput. When multiple wafer holders are provided on both sides of the polishing belt assembly, a linear pad conditioning assembly of the present invention can be provided on each side of the polishing belt.

According to the present invention, a linear pad conditioning assembly 204 is mounted proximately to polishing belt 201, so as to provide conditioning for the polishing pad on the surface of polishing belt 201. As discussed in further detail below, linear pad conditioning assembly 204 includes a linear motion mechanism that allows a conditioning surface to travel in the directions indicated by reference numeral 209. The combined motions of the linear motion mechanism and polishing belt 201 accomplish linear conditioning of the polishing pad.

Figure 3A:
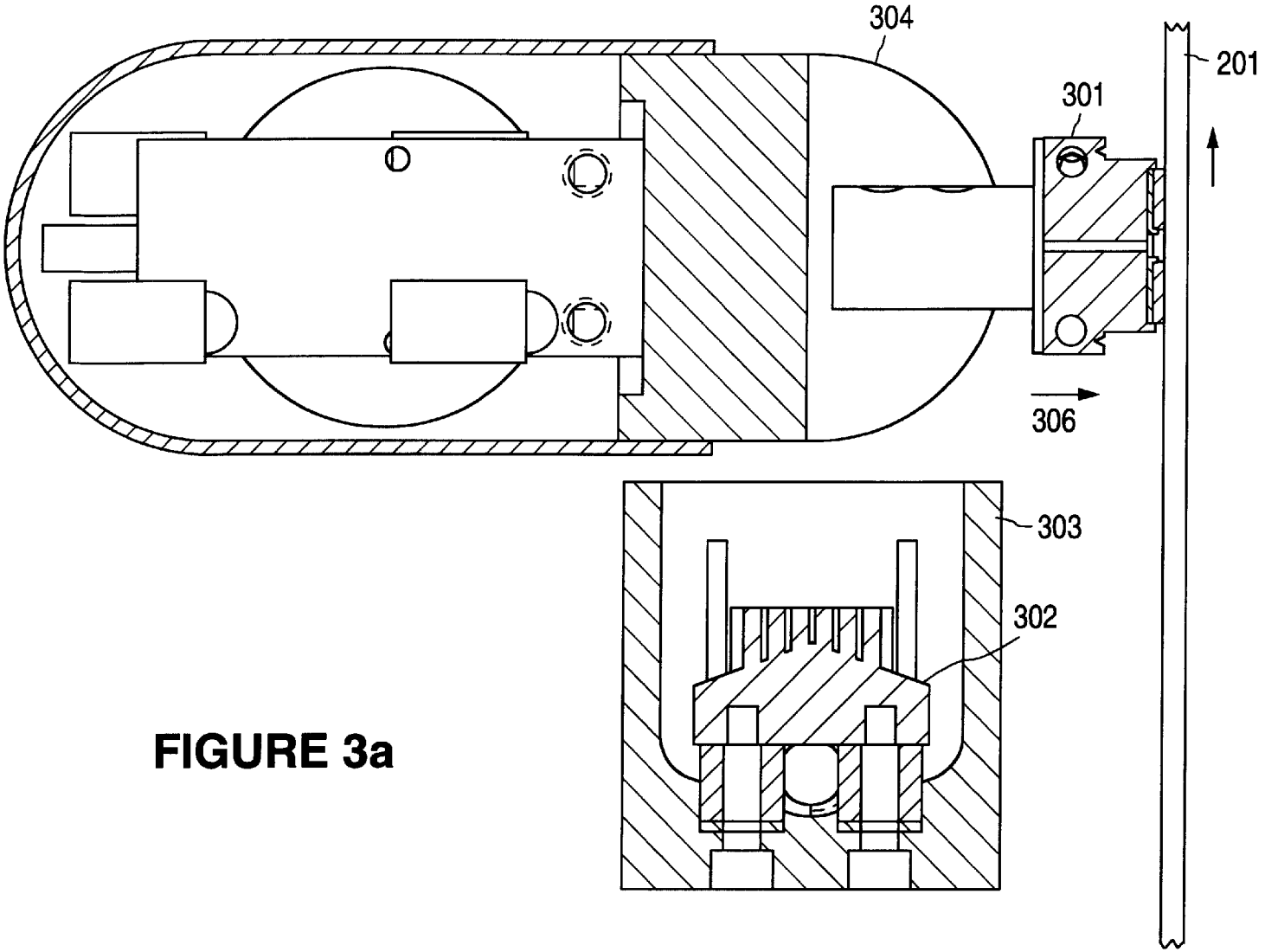
FIGS. 3*a* and 3*b* show, respectively, a first and a second operational positions of conditioner block assemblies 301 in pad conditioning assembly 204, in accordance with the present invention.
Figure 3B:
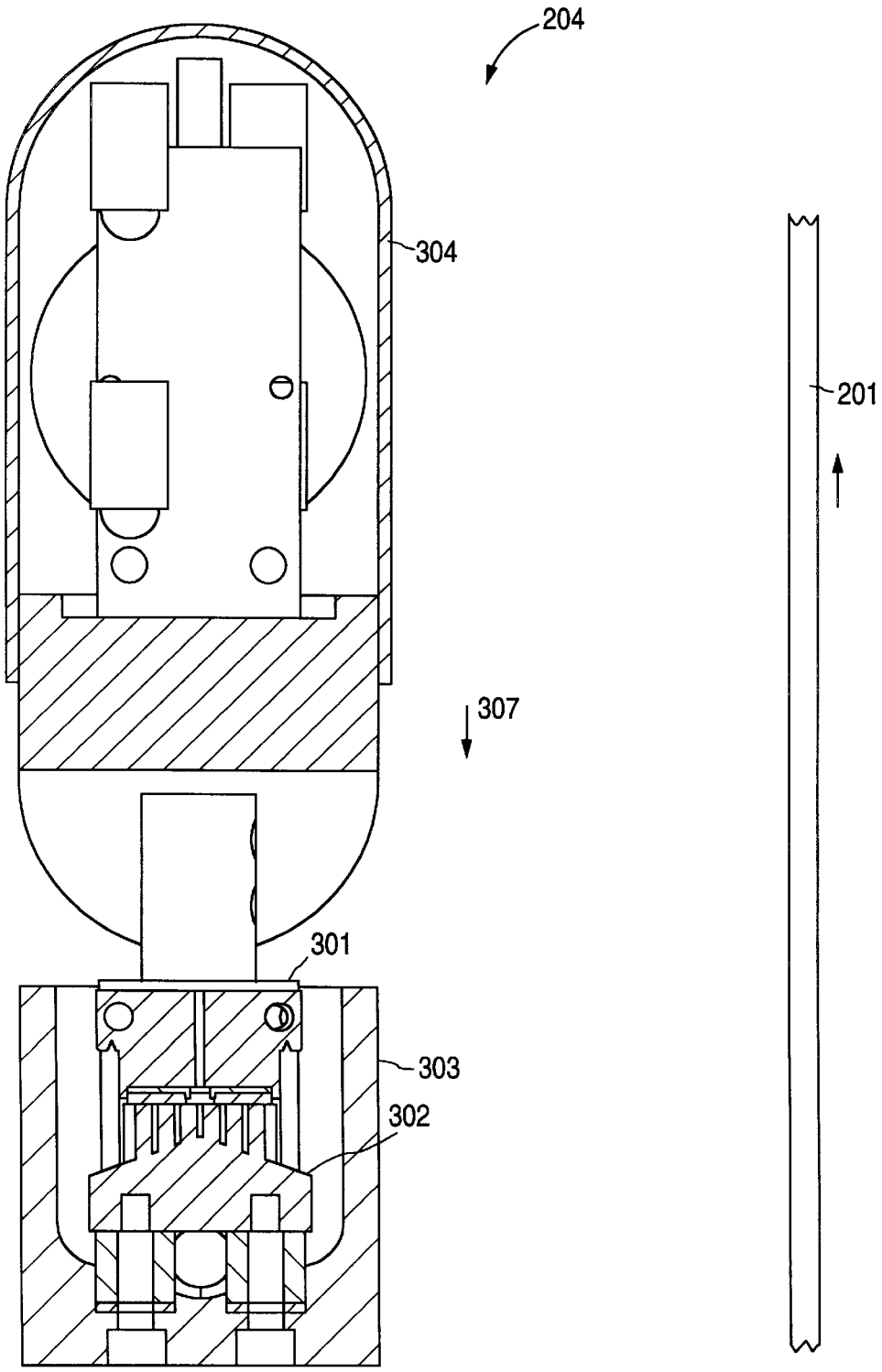

FIGS. 3*a* and 3*b* illustrate two operational positions of linear conditioning assembly 204. FIGS. 3*a* and 3*b* show linear conditioning assembly 204 driven by a driving means 304 in a first orientation, in which conditioner block assemblies 301 condition the polishing pad of polishing belt 201, and a second orientation, in which conditioner block assemblies 301 are cleaned in cleaning fluid bath 303 by a brush 302, respectively. Driving means 304 includes (i) a support mechanism 220 (shown in detail in FIG. 4 and discussed below) which houses a number of linear pneumatic cylinders for driving conditioner block assemblies 301 against, and retracting from, polishing belt 201 (in the direction indicated by reference numeral 306) in the first orientation, and driving conditioner block assemblies 301 against the bristles of brush 302 (in the direction indicated by reference numeral 307) in the second orientation; (ii) a linear oscillation mechanism 221 (shown in detail in FIG. 4) for driving conditioner block assemblies 301 in the lateral directions (i.e., the directions indicated by reference numeral 209 in FIG. 2*b*); and (iii) a rotational mechanism 222 (shown in detail in FIG. 4) for rotating conditioner assemblies 301 from the first orientation to the second orientation.

Figure 4:
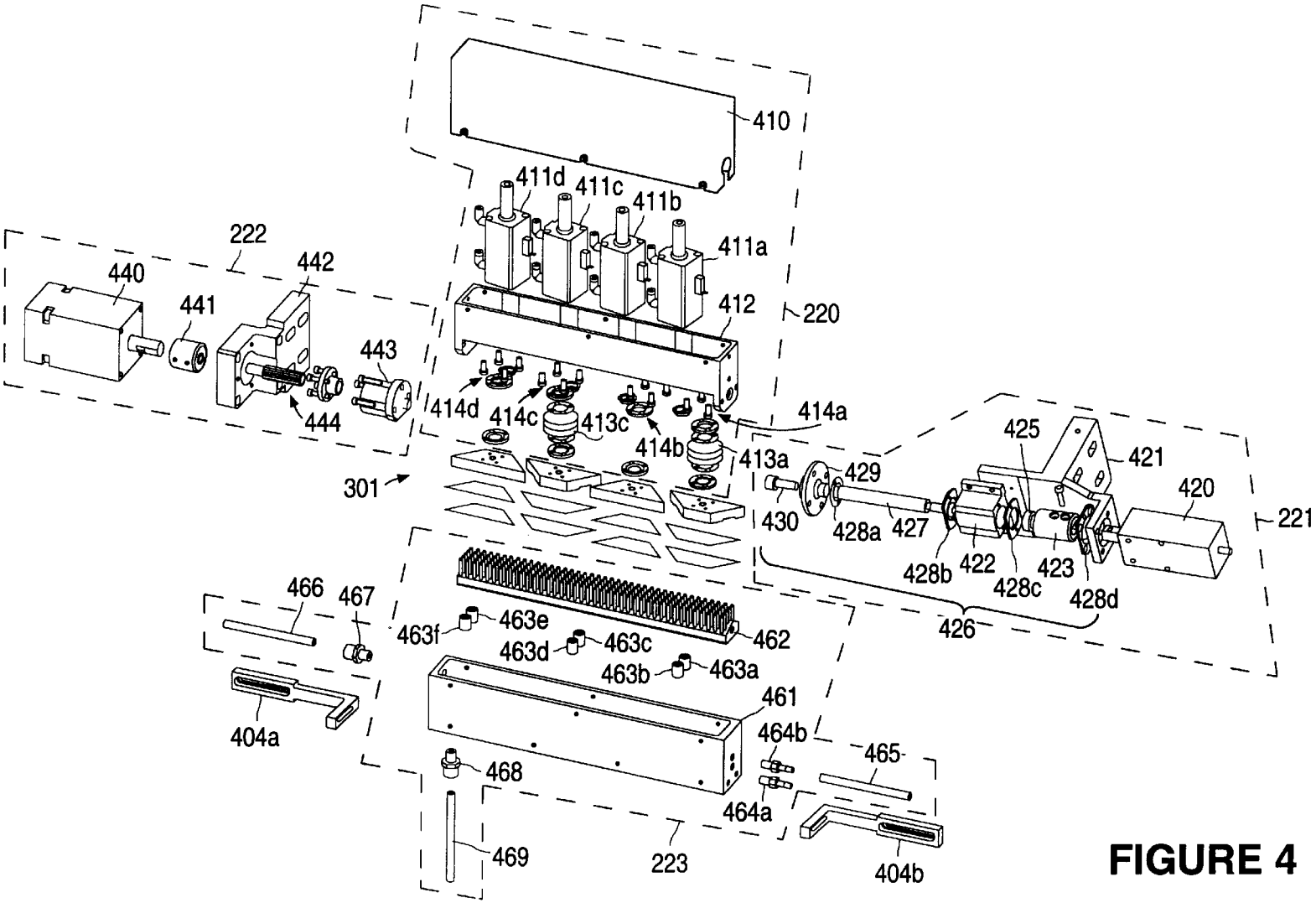
FIG. 4 shows pad conditioning assembly 204 in greater detail.

FIG. 4 shows in greater detail pad conditioning assembly 204. As shown in FIG. 4, pad conditioning assembly 204 includes conditioning assemblies 301, frame mounts 404*a* and 404*b*, support mechanism 220 including pneumatic cylinders 411*a* to 411*d*, linear oscillation mechanism 221, rotational mechanism 222 and bath assembly 223. Frame mounts 404*a* and 404*b* mount bath assembly 223 onto CMP apparatus 200.

As discussed above, support mechanism 220 houses pneumatic cylinders 411*a* to 411*d*, which position conditioner block assemblies 301 against either the polishing pad on polishing belt 201 or against the bristles of cleaning brush 302. As shown in FIG. 4, support mechanism 220 includes (i) a cover 410 for enclosing support mechanism 220, (ii) four sets of linear air cylinders, respectively labeled by reference numerals 411*a*–411*d*, (iii) a cylinder mounting block 412 for mounting linear air cylinders 411*a* to 411*d*, (iv) four sets of elastomeric bellows, respectively labeled by reference numerals 413*a*–413*d* (for clarity, bellows 413*b* and 413*d* not shown in FIG. 4), and (v) coupling assemblies 414*a*–414*d*, each coupling one of bellows 413*a*–413*d* to cylinder mounting block 412, so as to provide a covering for protecting the shaft of a respective one of linear air cylinders 411*a* through 411*d*. Air cylinders 411*a* to 411*d* are each driven pneumatically to transmit a predetermined pressure to urge, through their respective coupling linkages enclosed in bellows 413*a*–413*d*, conditioner block assemblies 301 against polishing belt 201 or brush 302. The air pressure in each of air cylinders 411*a* to 411*d* are preferably individually adjustable, so as to allow even finer tuning of the conditioning pressure on the polishing pad. Conditioner block assemblies 301 is described in further detail below.

Linear oscillation mechanism 221 includes (i) frame mount 421, for mounting linear oscillation mechanism 221 onto the chassis of CMP apparatus 200, (ii) an oscillating air cylinder 420, which is driven pneumatically to provide a linear oscillation, and (iii) a linear oscillation shaft assembly 426, which couples cylinder mounting block 412 and oscillating air cylinder 420 to transmit the linear oscillation of oscillating air cylinder 420 to cylinder mounting block 412 and hence, conditioner block assemblies 301. Linear oscillation shaft assembly 426 includes an oscillation coupling shaft 427, which is attached, at one end, to cylinder mounting block 412 through couplings 429 and 430 and, at the other end, to a self-aligning linear bearing 422. Bellows retaining plates 428*a*–428*d* are provided for attaching elastomeric bellows for protecting linear oscillation mechanism 221. A spherical bearing 425, housed in an adaptor 423, is provided, in conjunction with self-aligning linear bearing 422, to accommodate axial misalignment between rotational assembly 222 and linear oscillation assembly 221. Spherical bearing 425 accommodates the rotational motion of cylinder mounting block 412.

Rotational mechanism 222 includes (i) a frame mount 442, which mounts rotational mechanism 222 to the chassis of CMP apparatus 200, (ii) a rotational air cylinder 440, which is driven pneumatically to provide a rotational motion, (iii) a rotary adapter shaft 443 attached to cylinder mounting block 412, and (iii) a ball spline assembly 444, which couples rotational air cylinder 440 to rotary adapter shaft 443 through a rotary coupling 441. Ball spline assembly 444 transmits the rotational motion of rotational air cylinder 440 to cylinder mounting block 412, and hence conditioner block assemblies 301, thereby allowing conditioner block assemblies 301 to move between the first orientation, where conditioning of the polishing pad on polishing belt 201 occurs, and the second orientation, where cleaning of conditioner block assemblies 301 occurs. Ball spline assembly 444 accommodates the linear oscillation of oscillating air cylinder 420.

Figure 5A:
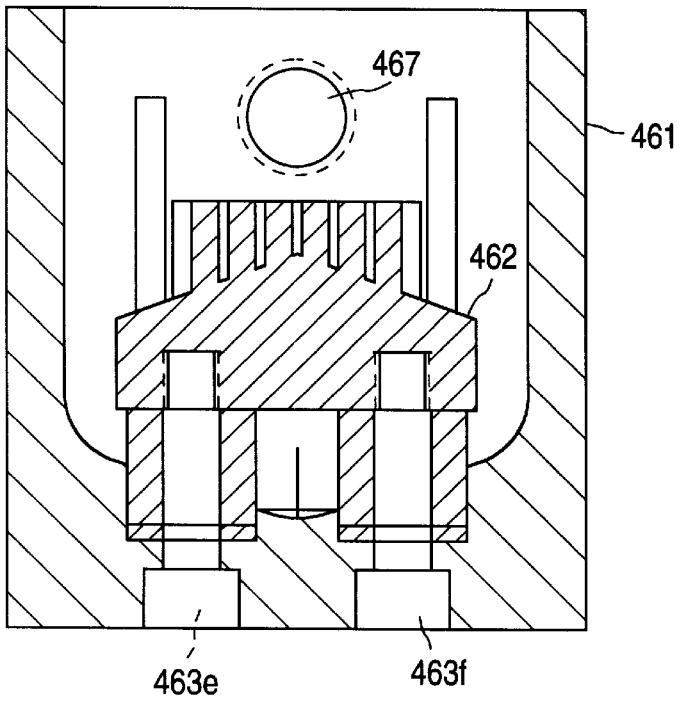
FIG. 5*a* shows a cross section of bath assembly 223.

Bath assembly 223 includes (i) a conditioner bath 461, which is mounted by frame mounts 404*a* and 404*b* onto the chassis of CMP apparatus 200, (ii) a brush 462 (i.e., brush 302 of FIG. 3), which is positioned inside conditioner bath 461 and lifted above the bottom of conditioner bath 461 by a number of stand-offs (indicated by reference numerals 463*a* to 463*f*), (iii) an inlet 464*a*, for filling conditioner bath 461 with water or a cleaning fluid, (v) a drain 468 for removing the fluid from conditioner bath 461, and (vi) a level drain 467 for maintaining the level of fluid in conditioner bath 461 to just above the brush bristles. A brush or cleaning fluid is provided via brush inlet 464*b* to brush 462. A cross section of bath assembly 223 is provided in FIG. 5*a*.

Figure 5B:
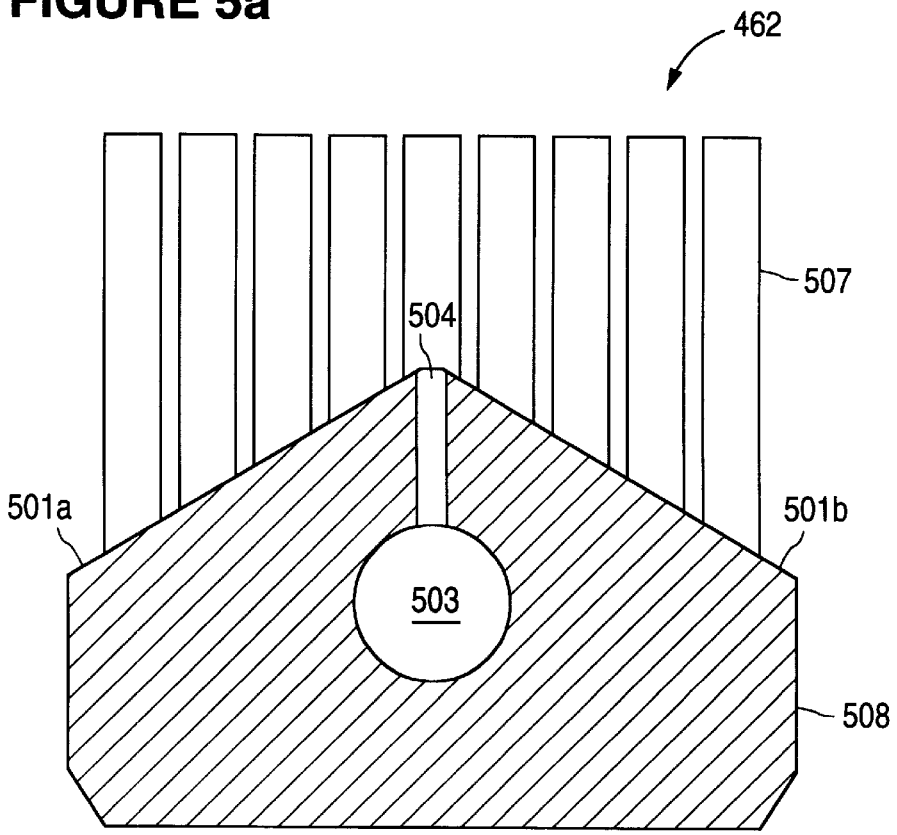
FIG. 5*b* shows a cross section of brush 462.

FIG. 5*b* shows a cross section of brush 462. As shown in FIG. 5*b*, a center bore 503 runs through the length of base 508 of brush 462, with ports 504 open to bristles 507 provided at regular intervals to provide a constant pressured flow of cleaning fluid directed against the surface of the conditioner blocks. In this embodiment, bristles 507 are provided each between 5 mils to 30 mils in diameter in 1/16 to 1/8 inch tufts arranged in a regular or staggered pattern, having a length between 500 mils and one inch. Base 508 has two sloping surfaces 501*a* and 501*b* provided at a slope of 30 to 35 degrees, to facilitate washing away any slurry particles dislodged by bristles 507. The tufts of bristles 507 and the constant fluid flow are designed to minimize particles being trapped in bristles 507.

Figure 6:
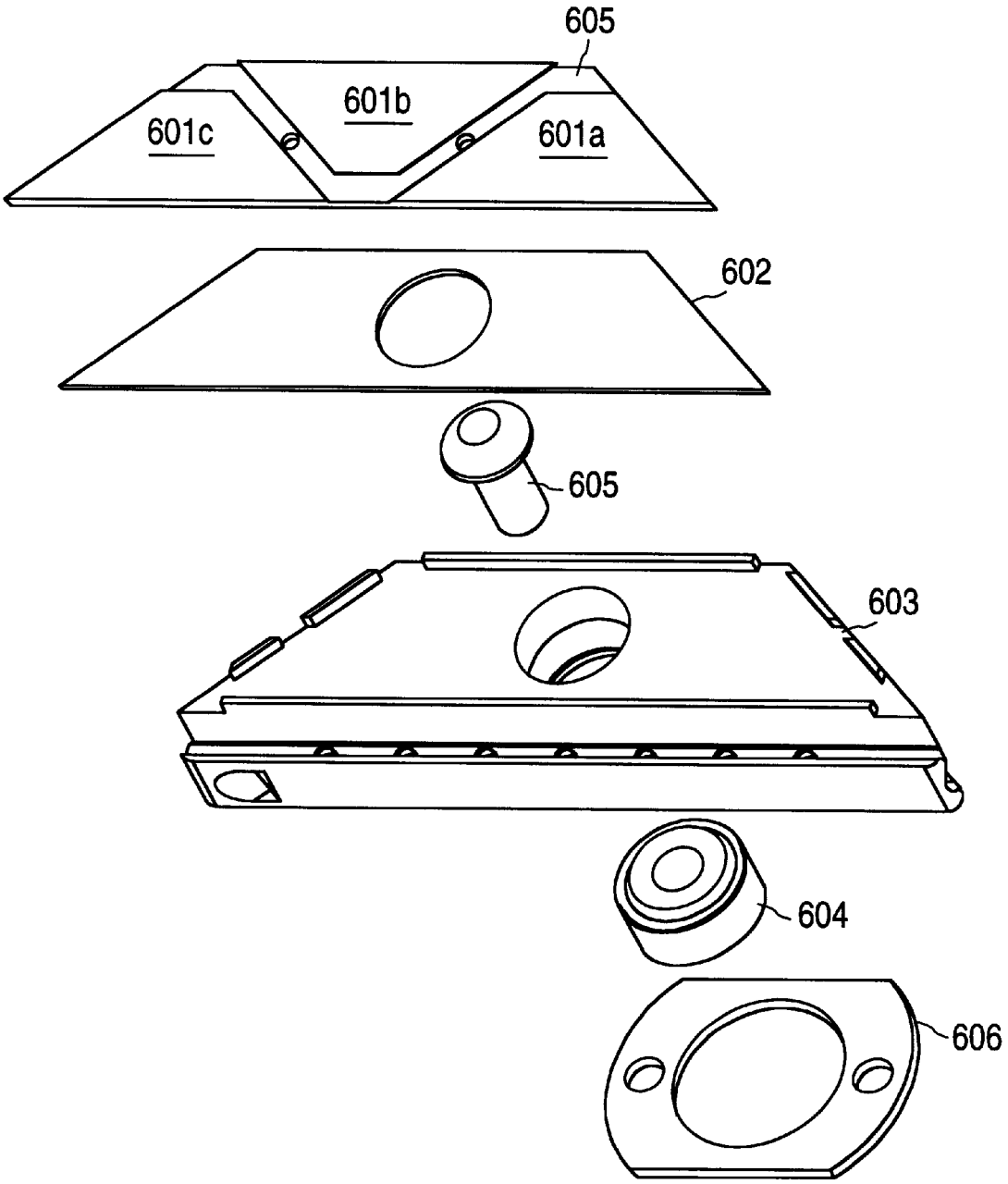
FIG. 6 shows in detail a conditioner block 600.

In this embodiment, conditioner block assemblies 301 includes four independently adjustable conditioner block assemblies 301*a*, 301*b*, 301*c* and 301*d*. An example of a conditioner block assembly of the type shown as conditioner block assemblies 301*a*, 301*b*, 301*c* and 301*d* is provided by conditioner block assembly 600 of FIG. 6. As shown in FIG. 6, conditioner block assembly 600 includes a diamond pad 601, a support pad 602 and a conditioner block 603. Provided in conditioner block 603 is a plane-spherical bearing 604 (shown in FIG. 6) which is attached to positioning mechanism 220 by a mounting bolt 605. Diamond pad 601 provides the conditioning surface for the polishing pad on polishing belt 201 (FIG. 2). Support pad 602 can be implemented by a magnetic pad holding diamond pad 601 in place magnetically. A bellows retaining plate 606 allows attachment of an elastomeric bellows for protecting the shaft of the corresponding one of air cylinder 411*a* through 411*d*.

Figure 7:
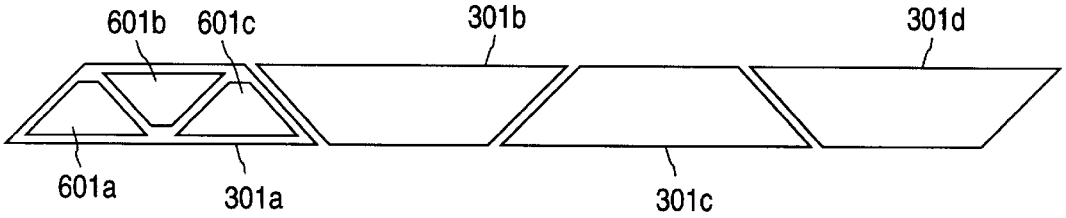
FIG. 7 shows the positions of conditioner block assemblies 301*a*, 301*b*, 301*c* and 301*d* relative to polishing belt 201.

In this embodiment, diamond pad 601 includes three trapezoidal conditioning surfaces 601*a*, 601*b* and 601*c*, which are spaced apart from each other by a groove 605. In each trapezoid, the angle between the bottom side and each of the slanting sides is 45 degrees. As shown in FIG. 6, conditioning surfaces 601*a*, 601*b* and 601*c* together provide an overall trapezoidal shape for diamond pad 601. The trapezoidal shape of diamond pad 601 generally conforms to the trapezoidal shape of each of conditioner block assemblies 301*a*, 301*b*, 301*c* and 301*d*. Conditioner block assemblies 301*a* to 301*d* are positioned in conjunction with trapezoidal surfaces 601*a*–601*c* of diamond pad 601 such that, when measured along the direction of travel of the polishing belt 201, a constant-width uniform contact surface is provided. The positions of conditioner block assemblies 301*a*, 301*b*, 301*c* and 301*d* relative to polishing belt 201 are shown in FIG. 7. As described in further detail below, a conditioner fluid is sprayed from a number of ports along the parallel sides of each of the conditioner blocks on to the polishing pad. In this manner, a linear conditioning with point-of-use conditioning fluid delivery is accomplished.

In addition, plane-spherical bearing 604 allows conditioner block 603 to gimbal up to a solid angle of 8 degrees, so as to allow a maximum-contact surface for diamond pad 601 even under non-uniform surface profile conditions on the polishing pad. Further, because the pressure upon each of conditioner block assemblies 301*a*, 301*b*, 301*c* and 301*d* can be individually adjusted, non-uniformity due to over- or under-conditioning discovered on the polishing pad can be corrected by adjusting the pressure on the corresponding conditioner block assembly. Such non-uniformity can be discovered by profilometric measurements.

Figure 8A:
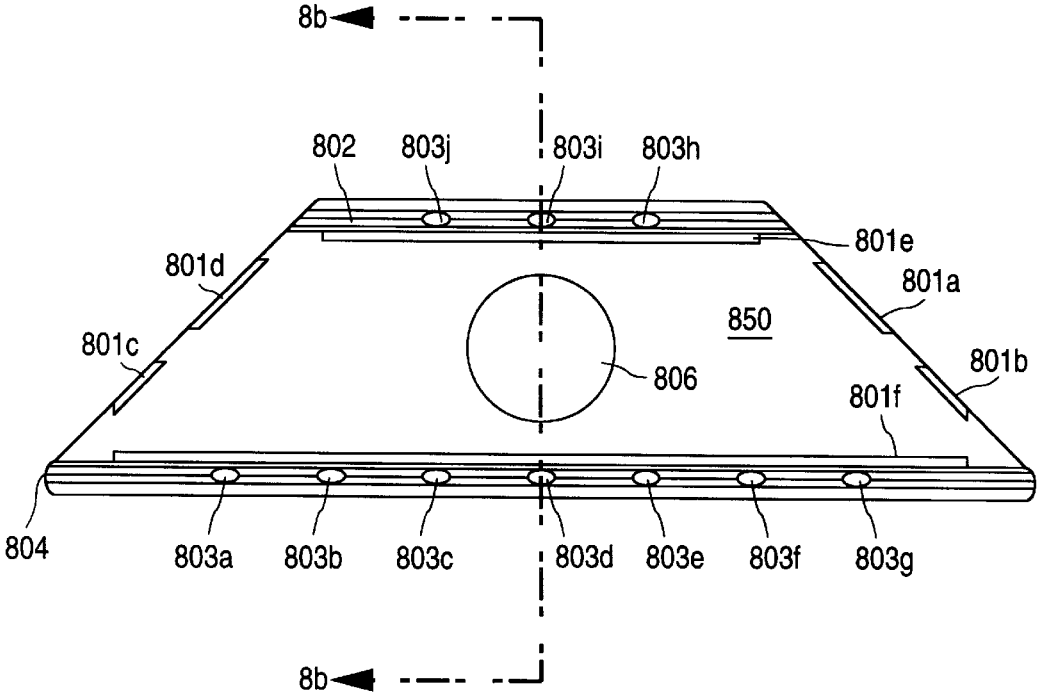
FIG. 8*a* shows a front side 850 of conditioner block 603 of FIG. 6, including fluid ports 803*a*–803*j*.

FIG. 8*a* shows "front" surface 850 of conditioner block 603. Front surface 850 is the surface of conditioner block 603 facing polishing belt 201. In this embodiment, surface 850 is recessed, so that support pad 602 diamond pad 601, when attached, are held in place by ledges 801*a* to 801*f*, positioned around the periphery of surface 850. Along the two parallel sides of surface 850 are a number of fluid ports 803*a*–803*j*, each connected to its neighbor fluid ports by one of the v-grooves 802 (along the shorter side of surface 850) and 804 (along the longer side of surface 850). Fluids exuding from fluid ports 803*a*–803*j* are guided by v-grooves 802 and 804 into a fine spray along the parallel sides of surface 850. Fluid ports 803*a*–803*j* are connected beneath surface 850 by a fluid delivery system described in further detail below. A cavity 806 is provide at a central position of conditioner block 603 to accommodate a plane-spherical bearing which allows conditioner block 603 a gimballing motion, so that diamond pad 601 supported by surface 850 can be positioned to provide maximum contact with the polishing pad on polishing belt 201.

Figure 8B:
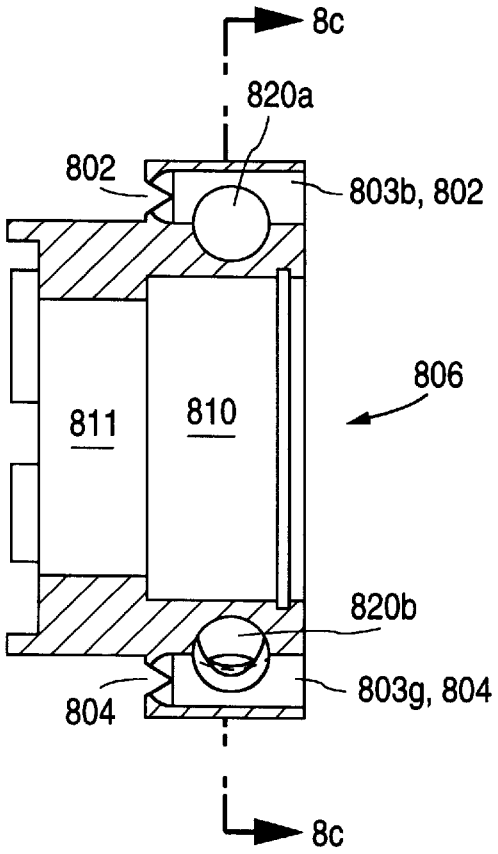
FIG. 8*b* shows a cross section of conditioner block 603, showing chamber 810 for accommodating a gimballing mechanism and fluid conduits 820*a* and 820*b* 12for delivery of a conditioning fluid.

FIG. 8*b* shows a cross section of conditioner block 603, along a line A–A indicated in FIG. 8*a*. As shown in FIG. 8*b*, fluid port 803*b* and v-groove 802, on one of the parallel sides of surface 850, and fluid port 803*g* and v-groove 804, on the other parallel side of surface 850, are connected to conduits 820*a* and 820*b* bored inside conditioner block 603. In addition, cavity 806 opens into two chambers, indicated respectively in FIG. 8*b* by reference numerals 810 and 811. Chamber 810 houses the plane-spherical bearing which provides the gimballing action described above. Chamber 811 accommodates mounting bolt 605, which provides the linkage between conditioner block 600 and positioning mechanism 220.

Figure 8D:
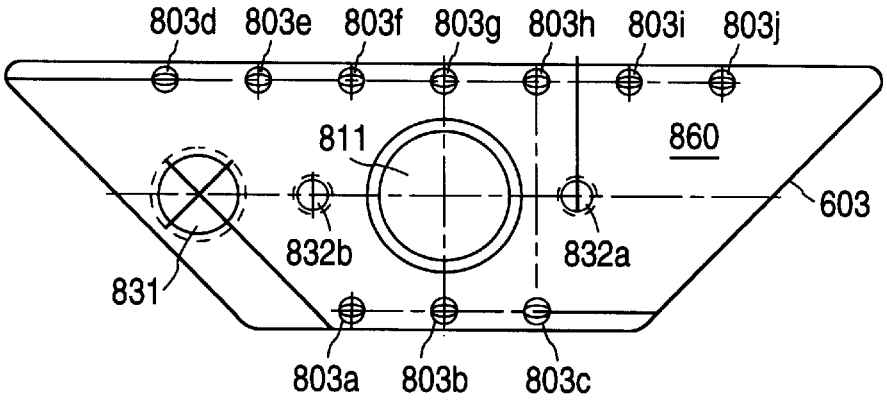
FIG. 8*d* shows a back surface 860 of conditioner block 603.
Figure 8C:
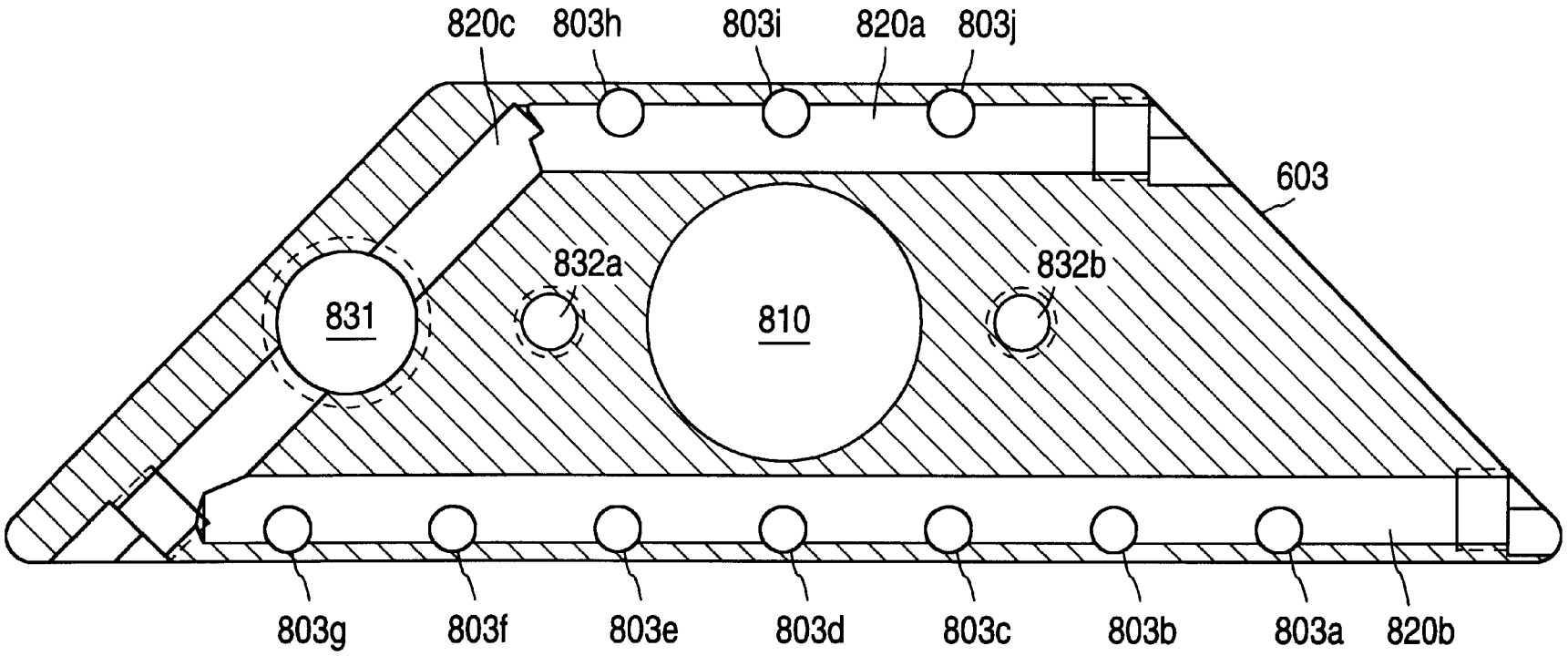
FIG. 8*c* shows a cross section of conditioner block 603, showing fluid conduits 820*a*, 820*b* and 820*c* and fluid inlet 831.

FIG. 8*c* shows a cross section of conditioner block 603, along a line D—D indicated in FIG. 8*b*. As shown in FIG. 8*c*, fluid conduits 820*a* and 820*b* are connected in conditioner block 603 by a third conduit 820*c*, which is connected to a fluid inlet 831. Fluid inlet 831 allows access to fluid conduits 820*a*, 820*b* and 820*c* by an externally connected conditioning fluid supply line (not shown). In this embodiment, conduits 820*a* and 820*b*, which are created by drilling from one side of conditioner block 603, are plugged from that side, so as to force the conditioner fluid to exit under pressure through fluid ports 803*a*–803*j*. Shown in FIG. 8*c* also are cross sections of two threaded bores 832*a* and 832*b*, which allow attachment to conditioner block 603 by one of bellows 413*a* to 413*d* (FIG. 4) of positioning mechanism 220 described above.

FIG. 8*d* shows back surface 860 of conditioner block 603. In this embodiment fluid ports 803*a*–803*j* are provided in conditioner block 603 by boring through conditioner block 603 from surface 860. The openings of fluid ports 803*a*–803*j* at surface 860 are then plugged to ensure that fluid exudes only from the openings at surface 850.

Figure 9:
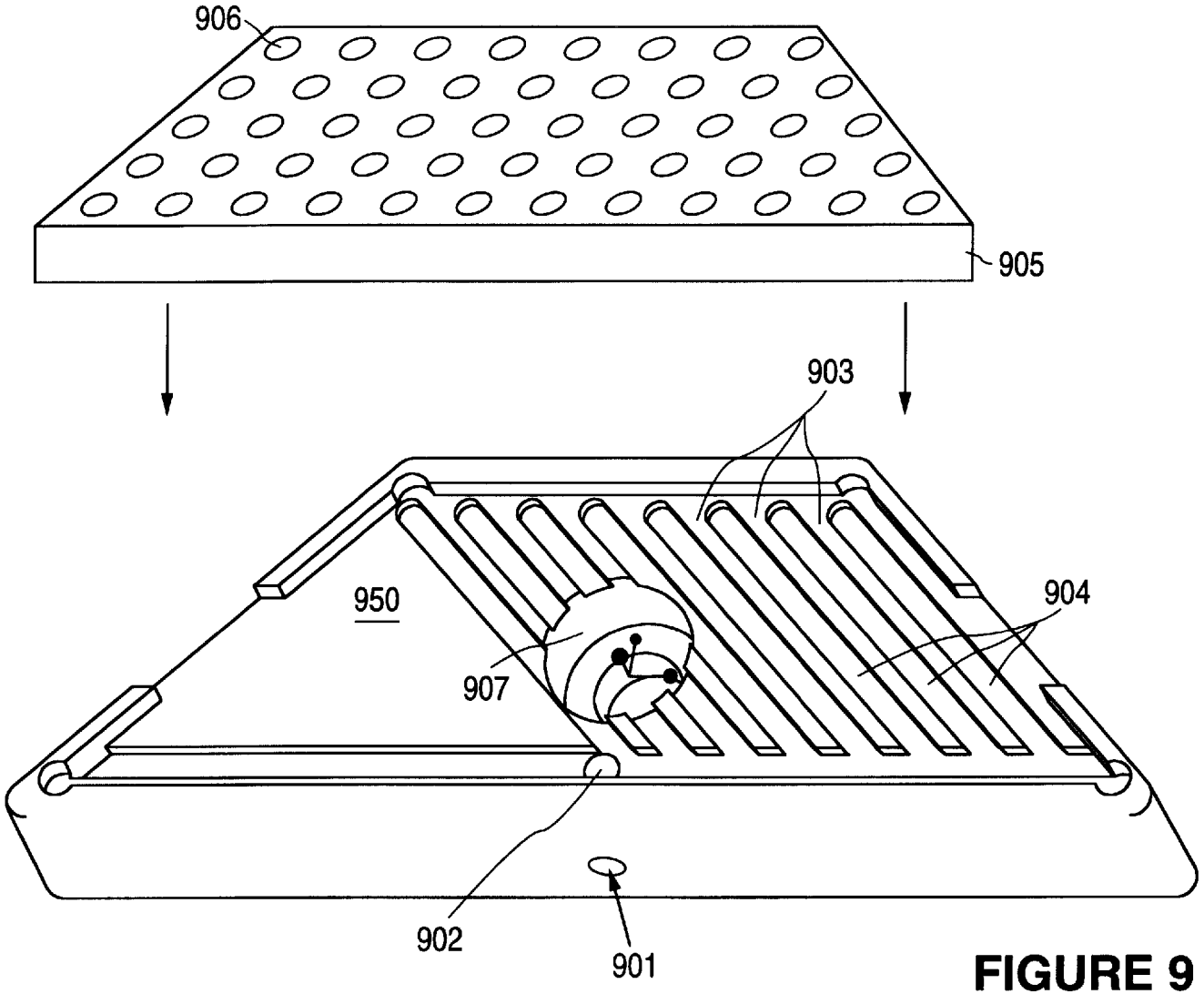
FIG. 9 shows a conditioner block 900 in a second embodiment of the present invention.

FIG. 9 shows a conditioner block 900, in another embodiment of the present invention. In this embodiment, rather than having a number of fluid ports along the parallel sides of the trapezoidal conditioner block, such as fluid ports 803*a*–803*j* described above in conjunction with conditioner block 603, conditioner block 900 includes a fluid inlet 901 provided on the side of conditioner block 900 and a fluid port 902 opening to front surface 950 of conditioner block 900.

Surface 950 is provided with a number of fluid channels, indicated by reference numeral 904, among a supporting structure of ridges, indicated by reference numeral 903. In this embodiment, a perforated conditioning pad 905 is used, so that a conditioning fluid provided through fluid inlet 901 is distributed evenly over surface 950 upon exiting from port 902, and forced through the perforations 906 of conditioning pad 905. In this manner, a linear conditioning of a polishing pad with point-of-use conditioning fluid delivery is also achieved.

The detailed description above is provided to illustrate the specific embodiments of the present invention and is not intended to be limiting. Numerous variations and modification within the scope of the present invention are possible. The present invention is set forth in the following claims.

We claim:

1. A linear pad-conditioning mechanism for a linear moving polishing pad in a polishing apparatus, said linear polishing pad moving in a first direction, said linear pad-conditioning mechanism comprising:

a plurality of conditioning assemblies, each conditioning assembly including a conditioning pad for conditioning said polishing pad;

a positioning mechanism, coupled to said conditioning assemblies, for positioning each of said conditioning assemblies on said polishing pad; and a linear oscillation mechanism, coupled to said conditioning assemblies, said oscillation mechanism driving each of said conditioning assemblies in an oscillatory linear motion along a second direction different from said first direction.

2. A linear pad-conditioning mechanism as in claim 1, further comprising an rotational mechanism coupled to said conditioning assemblies, said rotational mechanism providing a rotational motion for positioning each of said conditioning assemblies from a first orientation to a second orientation.

3. A linear pad-conditioning mechanism as in claim 2, further comprising a cleaning bath, wherein, in said second orientation, said positioning mechanism positions each of said conditioning assemblies for cleaning in said cleaning bath.

4. A linear pad-conditioning mechanism as in claim 1, wherein each of said conditioning assembly comprises a conditioner block including conduits for delivering a conditioning fluid.

5. A linear pad-conditioning mechanism as in claim 4, wherein said conditioner block includes:

a fluid inlet for receiving said conditioning fluid; and a fluid port coupled to said fluid inlet through a conduit in said conditioner block for providing said conditioning fluid to said conditioning pad.

6. A linear pad-conditioning mechanism as in claim 5, wherein said conditioning pad includes a plurality of perforations, such that said conditioning fluid exudes from said fluid port and distributes via said perforations on to said polishing pad.

7. A linear pad-conditioning mechanism as in claim 5, wherein said conditioner block includes:

a fluid inlet for receiving said conditioning fluid;

a plurality of fluid ports each coupled to said fluid inlet through a conduit in said conditioner block, and positioned along a periphery of said conditioner block, for providing said conditioning fluid to said conditioning pad; and a groove connecting said plurality of fluid ports on a surface of said conditioner block, so that conditioning fluid exuding under pressure from said fluid ports is guided by said groove to form a fine spray on to said polishing pad along said groove.

8. A linear pad-conditioning mechanism as in claim 1, wherein each of said conditioning assemblies includes a trapezoidal surface for attachment of said conditioning pad.

9. A linear pad-conditioning mechanism as in claim 8, wherein said conditioning assemblies being positioned such that, in said first direction, said conditioning assemblies providing a constant-width surface for conditioning said polishing pad.

10. A linear pad-conditioning mechanism as in claim 9, wherein said conditioning pad on each of said conditioning assemblies includes a plurality of trapezoidal portions.

11. A linear pad-conditioning mechanism as in claim 4, wherein said conditioning block further comprises a gimballing mechanism for positioning said conditioning pad to ensure substantial contact with said polishing pad.

12. A linear pad-conditioning mechanism as in claim 1, wherein said positioning mechanism comprises a plurality of pneumatically driven air cylinders.

13. A linear pad-conditioning mechanism as in claim 12, wherein pressures in said plurality of pneumatically driven air cylinders are individually adjustable.

14. A linear pad-conditioning mechanism as in claim 3, further comprising a brush in said cleaning bath for cleaning said conditioning pad in each of said conditioning assemblies.

15. A linear pad-conditioning mechanism as in claim 14, wherein said brush includes bristles provided on a base, said base including:

a fluid inlet for receiving a cleaning fluid;

a plurality of fluid ports opening to said bristles for delivering said cleaning fluid to said bristles; and a conduit within said base coupling said fluid inlet to said fluid ports.

16. A linear pad-conditioning mechanism as in claim 15, wherein said base including a first and a second slanting surfaces to facilitate a flow of said cleaning fluid carrying particles from said bristles.

17. A linear pad-conditioning mechanism as in claim 3, wherein said cleaning bath comprises:

a fluid inlet positioned on a side wall of said cleaning bath for providing said cleaning fluid into said cleaning bath;

a first fluid outlet provided on at the bottom of said cleaning bath for draining said cleaning fluid; and a second fluid outlet, positioned on a side wall of said cleaning bath at substantially the same level as a brushing surface of said brush bristles, for controlling a level of said cleaning fluid in said cleaning bath.

18. A linear pad-conditioning mechanism as in claim 1, wherein each of said conditioning assemblies is provided, in a predetermined position generally parallel to said polishing pad, each of said conditioning assemblies further comprising a gimballing mechanism for allowing said conditioning pad to gimbal around said predetermined position up to a predetermined solid angle.

19. A linear pad-conditioning mechanism as in claim 18, wherein said gimballing mechanism includes a plane spherical bearing.

* * * * *